US008905906B2

(12) United States Patent
Man et al.

(10) Patent No.: US 8,905,906 B2
(45) Date of Patent: Dec. 9, 2014

(54) ADAPTOR FOR CONVERTING CONVENTIONAL OFFICE CHAIR INTO A MULTIFUNCTIONAL OFFICE/FITNESS CHAIR

(76) Inventors: Yan-Gao Man, Burtonsville, MD (US); Guangping Gao, Xiang Fan (CN); Michael Mai, Guangdon (CN)

( * ) Notice: Subject to any disclaimer, the term of this patent is extended or adjusted under 35 U.S.C. 154(b) by 484 days.

(21) Appl. No.: 13/298,472

(22) Filed: Nov. 17, 2011

(65) Prior Publication Data

US 2013/0130876 A1 May 23, 2013

(51) Int. Cl.
*A63B 26/00* (2006.01)
*A63B 23/02* (2006.01)

(52) U.S. Cl.
CPC ..... *A63B 23/02* (2013.01)
USPC ..... 482/142; 482/140

(58) Field of Classification Search
CPC ..... A63B 23/00; A63B 23/0205; A63B 23/0216; A63B 23/0222; A63B 23/0227
USPC ..... 482/92, 131, 132, 140, 142, 148, 139; 297/69, 90, 423.21, 1, 3, 354.1
See application file for complete search history.

(56) References Cited

U.S. PATENT DOCUMENTS

| | | | | |
|---|---|---|---|---|
| 5,044,633 | A * | 9/1991 | Rice | 482/138 |
| 5,599,260 | A * | 2/1997 | Rovinsky et al. | 482/121 |
| 5,690,594 | A * | 11/1997 | Mankovitz | 482/121 |
| 6,966,871 | B2 * | 11/2005 | Parmater | 482/140 |
| 7,549,705 | B2 * | 6/2009 | Man et al. | 297/423.21 |
| 2010/0069801 | A1 * | 3/2010 | Tsai | 601/134 |

* cited by examiner

*Primary Examiner* — Loan H Thanh
*Assistant Examiner* — Nyca T Nguyen
(74) *Attorney, Agent, or Firm* — Ming Chow; Sinorica, LLC

(57) ABSTRACT

The invention is directed to an adaptor for converting a conventional office chair into a multifunctional office/fitness chair. The adaptor comprises a seat connector, a pair of rowing shafts, a seat post holder, and a foldable footrest. By adjusting the angle of the backrest up to 120°, a user can use the converted chair either as a conventional office chair, or as a fitness chair capable of assisting the user to do sit-up exercises in a rowing motion which focuses the exercise forces on the abdominal muscles, burns abdomen fat pad, and therefore effectively reduces waist line. Further, because the rowing motion is assisted by the backrest and armrest, the risk to injure the neck or back is eliminated.

3 Claims, 3 Drawing Sheets

ADAPTOR FOR CONVERTING CONVENTIONAL OFFICE CHAIR INTO A MULTIFUNCTIONAL OFFICE/FITNESS CHAIR

BACKGROUND OF THE INVENTION

1. Field of the Invention

The invention relates to a multifunctional adaptor for converting a conventional chair into a multifunctional office/fitness chair.

2. Description of the Related Art

A national-wide survey by the Centers for Disease Control and Prevention (CDC) has revealed that the number of overweight individuals increases linearly during the past 20-years. Currently, 56% of the US population has overweight problems, 1 in 5 is obese, and 7.3% has overweight related diabetes. Since the anterior abdomen is not covered by bone or cartilage, it has the greatest tendency and capacity for fat accumulation and expansion. All or nearly all the fat accumulation starts at, and over 90% of the excessive fat are stored in, the abdomen region. Overly accumulated fat directly compresses the liver, diaphragm, and gastrointestinal tract; disturbs blood circulation; increases heart and lung workload; and has been implicated as the primary cause for heart, lung, kidney diseases, and related death. A follow-up study (1997-2006) of over 100,000 American men and women by the American Cancer Society showed that individuals with an increased waist line have a two-fold increase in the mortality rate over individuals with a normal waist line.

More and more studies have shown that physical exercise is one of the most effective ways to improve general health. In particular, sit-up has been found to be the most effective exercise for reducing fat in anterior abdomen. Unfortunately, with the protruded fat pad, it is difficult for overweight individuals to do sit-up exercise. Also, it is not easy for elders to do sit-up exercise due to weakened muscles. In addition, doing sit-up without the appropriate protection may cause back and neck injuries.

In a previous invention, U.S. Pat. No. 7,549,705, we have developed a specialized multifunctional office/fitness chair for assisting abdominal muscle exercise. The chair has a pivot capable of rotating chair backrest up to about 90 degrees away from the seat surface, and allowing a user to adjust the backrest to various angles. Depending on the angles, the chair can be used as a regular chair, or a recliner, which is capable of assisting a user to do sit-up and other exercises, and effectively reduces the anterior abdomen fat. Scientific study has shown that 3-5 minute exercise with the multifunctional chair could burn an equivalent amount of calories that would have required 10-15 minute moderate speed running on a tread mill Noticeable waist line reductions are observed within two weeks on test volunteers using the multifunctional chair 5-7 minutes per day. However, as the multifunctional chair requires a special design with a unique structural configuration, the choices available to the users in chair comfort and preference are limited.

To improve the chair design and offer more functions, the present invention provides an adaptor which can be used to convert a conventional office chair into a multifunctional office/fitness chair. The converted multifunctional chair not only retains all the exercising functions of the previous multifunctional chair, but also allows the user to select and gain additional preferred chair design features, such as the choice of the construction materials, adjustable chair heights, 360 degree swivel around a chair seat post, and rollers for easy relocation, etc.

SUMMARY OF THE INVENTION

The invention is directed to an adaptor for converting a conventional office chair into a multifunctional office/fitness chair. The adaptor comprises a seat connector, a rotatable pivoting component, a reclining angle setting component, a pair of rowing shafts, a seat post holder, and a foldable footrest. By adjusting the angle of the backrest, a user can use the converted chair either as a conventional office chair, or as a fitness chair capable of assisting the user, including an overweight person, to do sit-up exercises in a rowing motion which focuses the exercise forces on the abdominal muscles, burns abdomen fat pad, and therefore effectively reduces the waist line. Further, because the rowing motion is assisted by the backrest and armrest, the risk to injure the neck or back is eliminated. Another embodiment of the innovation is a chair comprising said adaptor.

DETAILED DESCRIPTION OF THE INVENTION

Figure 1:
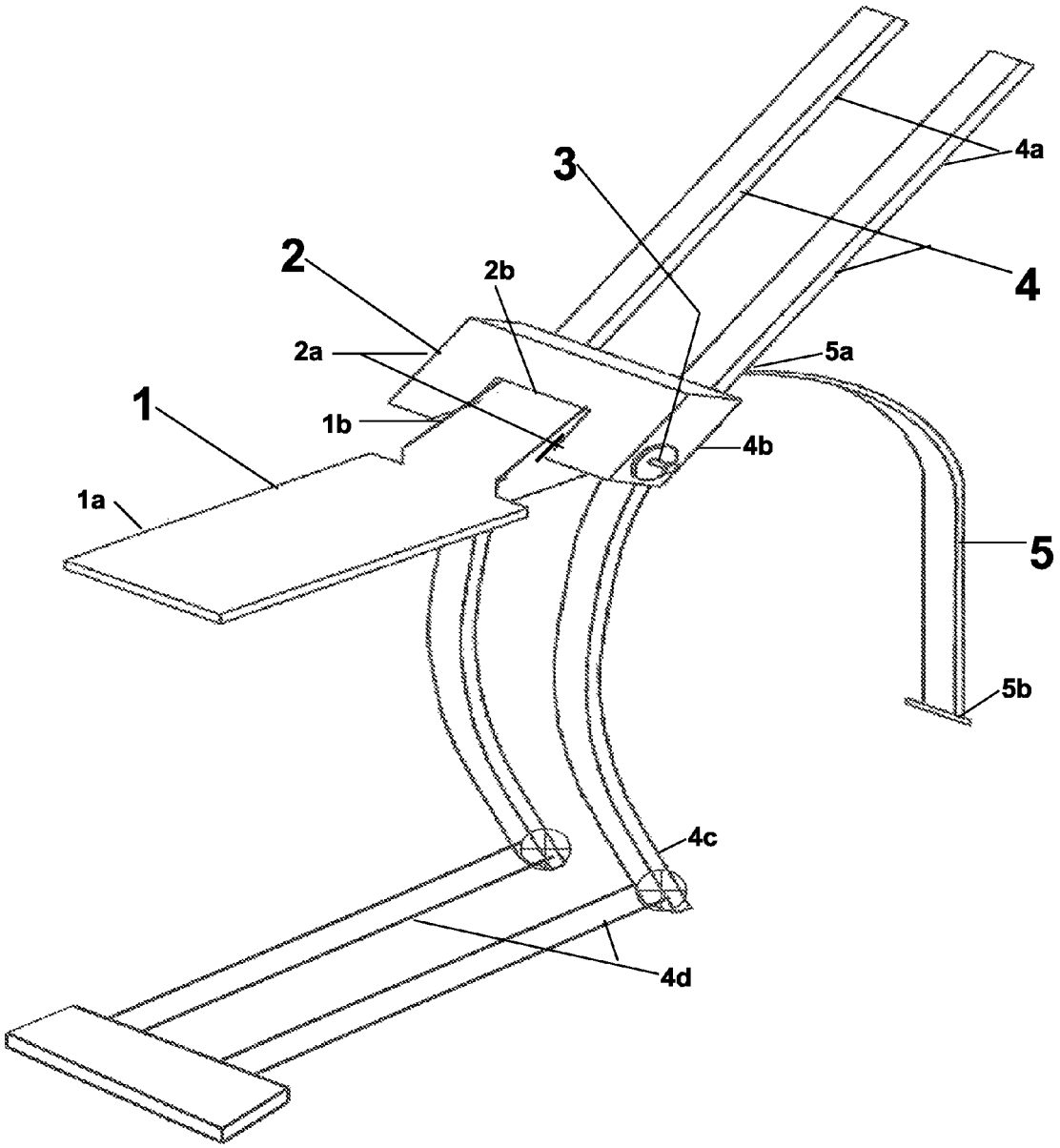
FIG. 1 (1/3) is a side view of the seat connector which comprises a rotatable pivoting component, a reclining angle setting component, a pair of supporting rods, a seat connecting plate, and a balancing leg.

Turning to the drawings, FIG. 1 (1/3) shows a side view of the seat connector, which comprises a seat connecting plate 1, a rotatable pivoting component 2, a reclining angle setting component (see 6, 7, 8, and 9 in FIG. 2 below), a centered round metal bar 3, a pair of supporting rods 4, and a balancing leg 5. The seat connecting plate 1 has a front end 1*a* adapted for attaching the entire seat connector 1 to the bottom side of the seat, such as by inserting into a space between the connector plate on top of the post and the bottom surface of the seat, then tightly mounting the inserted front end 1*a* to the seat bottom side with metal screws. The pivoting component 2 is positioned at the joint between the backrest and seat (see 2 and 3 in FIG. 2 below), and is adapted to be able to rotate the backrest up to 120° away from the chair seat surface, such as by configuring a rotatable bracket (H-shaped) 2*a* over a cylindrical surface area of a base 2*b*. The center of the back side of the pivoting component 2 is connected to the reclining angle setting component (see 6, 7, 8, and 9 in FIG. 2 below). The rotatable bracket 2*a* and the base 2*b* of the pivoting component 2 is joined to the upper surface of the rear end 1*b* of the seat connecting plate 1 using a centered round metal bar with metal screws 3 on the surface of both sides. The upper sections 4*a* of a pair of supporting rods 4 are adapted to be mounted on the back side of the backrest by screws (see 1*a* in FIG. 2 below). The middle sections 4*b* of a pair of supporting rods 4 are mounted vertically to the same back side of the pivoting component 2, which is connected to the reclining angle setting component (see 1*b*, 6, 7, 8, and 9 in FIG. 2 below). The lower ends 4*c* of a pair of supporting rods 4 are adapted to be connected to the rear ends of a pair of rowing shafts 4*d*. The upper end 5*a* of the balancing leg 5 is attached to the lower face of the seat connecting plate 1 at the rear end which joins to the pivoting component 2. The lower end 5*b* of the balancing leg 5 extends towards floor, and is terminated with a floor contacting component, such as a horizontal rod or pad. The balancing leg 5 prevents accidental falling back of the backrest, and provides additional balancing support to the chair during exercise. The balancing leg 5 has a width which is substantially narrower than the width of the pivoting component 2, and is positioned in the middle between a pair of the backrest supporting rods 4.

Figure 2:
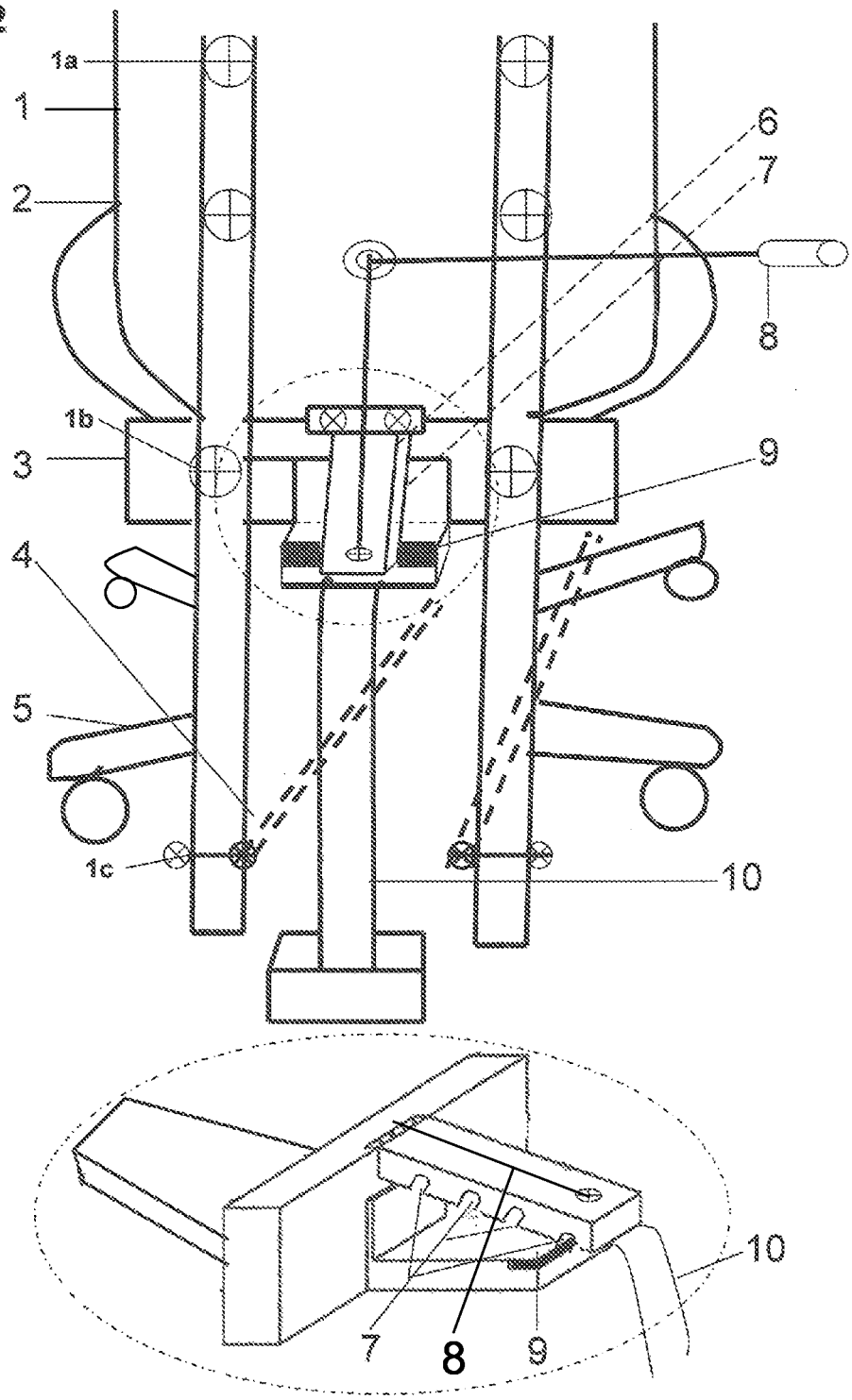
FIG. 2 (2/3) is a back view of an adaptor which has been assembled to a conventional office chair.

FIG. 2 (2/3) shows the back view of an adaptor which has been assembled to a conventional office chair. The upper sections 1*a* of a pair of supporting rods 1 are mounted to the back side of the backrest 2. The middle sections 1*b* of a pair of supporting rods are mounted to the back side of a rotatable pivoting component 3. The lower ends 1*c* of a pair of supporting rods are coupled with the rear ends of a pair of rowing shafts 4 with rotatable joints, which are laid on a holding structure (see 3 in FIG. 3 below) rested on legs 5 of the chair. A foldable reclining angle setting component 6 is mounted to the rotatable pivoting component 3. The inner face of the angle setting component has four half moon-like depressions 7. The backrest of the chair can be adjusted to four different angles by lifting the angle setting component 6 with the handle 8 and placing each of the four depressions 7 against a breaker 9 mounted on the surface of the supporting leg 10.

Figure 3:
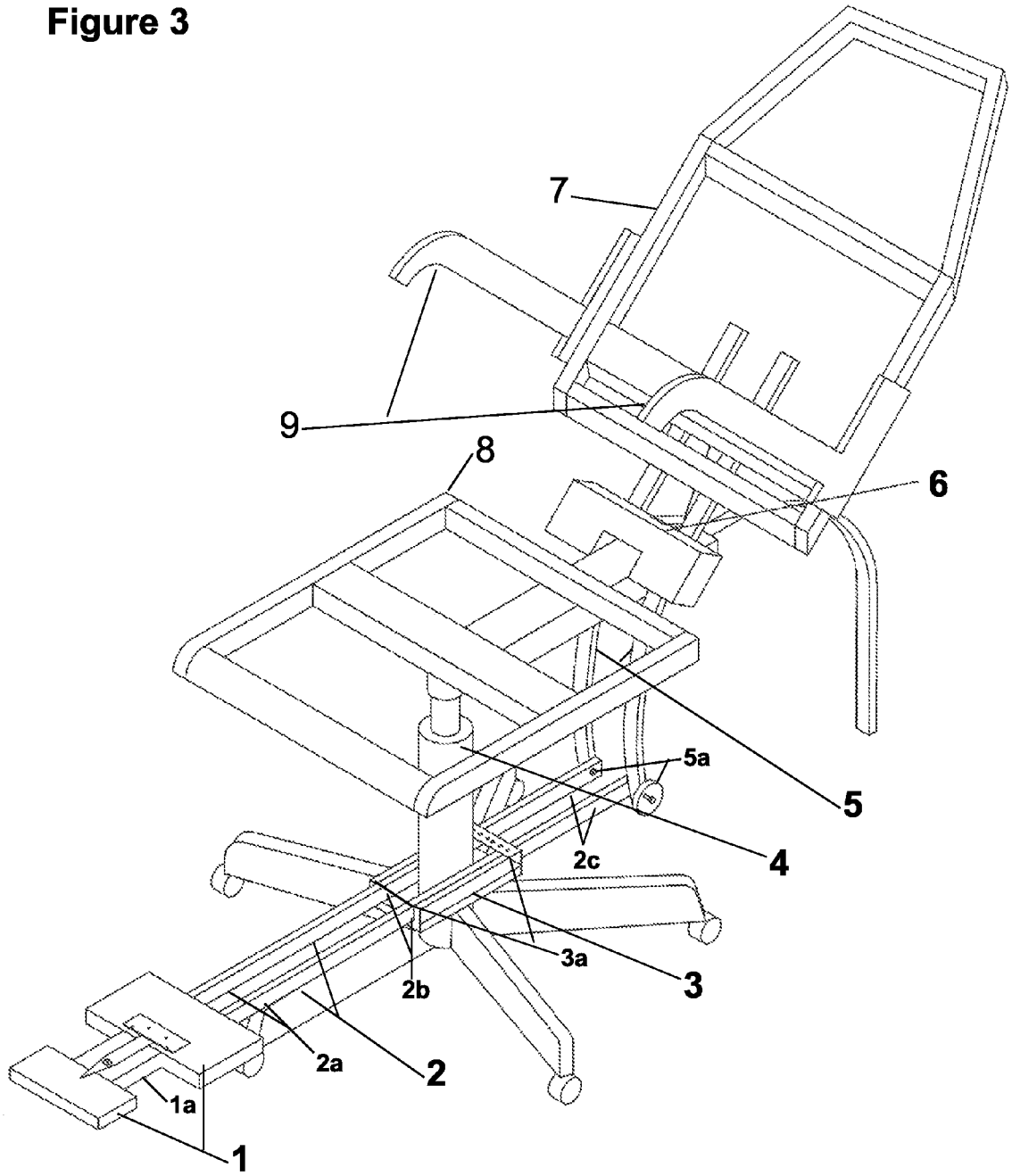
FIG. 3 (3/3) is a side view of an adaptor which has been assembled to a conventional office chair.

FIG. 3 (3/3) shows the side view of an adaptor which has been assembled to a conventional office chair. A foldable footrest 1 is securely connected with the front ends 2*a* of a pair of longitudinal rowing shafts 2. The footrest 1 has a flexible joint 1*a* in the middle portion for stowing a pair of shoe-like foot holding structures away by folding the footrest 1 under the seat. The middle sections 2*b* of the shafts 2 are placed in a pair of tracks 3*a* of a seat post holder 3, which is structured to surround the central seat post 4 of a conventional swivel office chair. The rear ends 2*c* of the shafts 2 have matching coupling structures for connecting to the coupling structures 5*a* of supporting rods 5, which are mounted to a rotatable pivoting component 6 and the backrest 7. The holder 3 is configured to securely fix the pair of tracks 3*a* for the longitudinal rowing shafts 2 on the opposite sides to the central seat post of the chair. The longitudinal shafts 2 are tubes which can be rowed back and forth by the user while the backrest 7 cooperatively rotates about the pivoting component 6 within an angle set by the reclining angle setting component (see 6, 7, 8, and 9 in FIG. 2 above). During exercise, the user sits on the seat 8, places feet in the shoe-like structure 1, and places forearms onto the armrests 9. By applying cooperative counter forces to the armrests 9 and the footrests 1, the shafts 2 are moved back and forth in the holder tracks 3*a* in a rowing motion mimicking the site-up movement. While the muscles of the entire body are exercised, the movements of abdominal muscles are the focal point, and the abdominal fat is burned away effectively. With the assistance provided by the backrest 9 and armrests 7, even an overweight person or elder can do the sit-up exercise safely without difficulty, and the risk to get back or neck injury is eliminated or significantly reduced.

Various materials, such as metal, reinforced plastics, and high strength composite materials, and the like, can be suitably selected to form the various components of the adaptor.

We claim:

1. An adaptor for converting a conventional office chair into a multifunctional office or fitness chair, said adaptor comprising:

a) a seat connector comprising a rotatable pivoting component, a seat connecting plate, a reclining angle setting component, a pair of supporting rods, and a balancing leg; wherein said pivoting component is positioned at a joint between a backrest and a seat of a chair and is adapted to be able to rotate the backrest up to 120° away from the chair seat surface; said seat connecting plate is attached to a bottom of the pivoting component and the entire seat connector is mounted to a bottom side of the seat; a center of a back side of the pivoting component is connected to the reclining angle setting component; middle sections of the pair of supporting rods are mounted vertically to opposite ends on the back side of the pivoting component; upper sections of the pair of supporting rods are adapted to be mounted on a back side of the backrest; lower ends of supporting rods are configured to have coupling structures; an upper end of the balancing leg is attached to a lower face of the seat connecting plate at a rear end; and a lower end of the balancing leg extends towards a floor, and is terminated with a floor contacting component;

b) a pair of longitudinal rowing shafts comprising front ends and rear ends;

c) a seat post holder configured to securely fix a pair of tracks for the pair of longitudinal rowing shafts on opposite sides of a central seat post of the chair; and d) a foldable footrest attached to the front ends of the pair of longitudinal rowing shafts, said foldable footrest comprising a foldable middle section and a pair of shoe-like structures at a front section.

2. The adaptor of claim 1, wherein the adaptor is formed or made from materials selected from the group of metal, reinforced plastics, and high strength composites.

3. A method of assisted sit-up exercise by using a converted office or fitness chair which is assembled by converting a conventional chair with an adaptor, said method comprising:

providing an adaptor, said adaptor comprising:

a) a seat connector comprising a rotatable pivoting component, a seat connecting plate, a reclining angle setting component, a pair of supporting rods, and a balancing leg; wherein said pivoting component is positioned at a joint between a backrest and a seat of a chair and is adapted to be able to rotate the backrest up to 120° away from the chair seat surface; said seat connecting plate is attached to a bottom of the pivoting component and the entire seat connector is mounted to a bottom side of the seat; a center of a back side of the pivoting component is connected to the reclining angle setting component; middle sections of the pair of supporting rods are mounted vertically to opposite ends on the back side of the pivoting component; upper sections of the pair of supporting rods are adapted to be mounted on a back side of the backrest; lower ends of supporting rods are configured to have coupling structures; an upper end of the balancing leg is attached to a lower face of the seat connecting plate at a rear end; and a lower end of the balancing leg extends towards a floor, and is terminated with a floor contacting component;

b) a pair of longitudinal rowing shafts comprising front ends and rear ends;

c) a seat post holder configured to securely fix a pair of tracks for the pair of longitudinal rowing shafts on opposite sides of a central seat post of the chair; and d) a foldable footrest attached to the front ends of the pair of longitudinal rowing shafts, said foldable footrest comprising a foldable middle section and a pair of shoe-like structures at a front section;

adjusting an angle of the backrest, wherein a user can use the converted chair either as a conventional office chair, or as a fitness chair capable of assisting the user to do sit-up exercises in a rowing motion.

* * * * *